US005558264A

United States Patent [19]

Weinstein

[11] Patent Number: 5,558,264

[45] Date of Patent: Sep. 24, 1996

[54] COMBUSTION-POWERED, FASTENER-DRIVING TOOL WITH GAS-ACTUATED, FASTENER-FEEDING MECHANISM

[75] Inventor: Valery G. Weinstein, Morton Grove, Ill.

[73] Assignee: Illinois Tool Works Inc., Glenview, Ill.

[21] Appl. No.: 388,215

[22] Filed: Feb. 13, 1995

[51] Int. Cl.[6] ..... B25C 1/04

[52] U.S. Cl. ..... 227/10; 227/112; 227/130

[58] Field of Search ..... 227/9, 10, 112, 227/138, 130

[56] References Cited

U.S. PATENT DOCUMENTS

| | | | |
|---|---|---|---|
| 3,488,825 | 1/1970 | Lundgren | 227/112 |
| 3,742,577 | 7/1973 | Buttriss | 227/112 |
| 4,313,552 | 2/1982 | Maurer | 227/112 |
| 4,483,474 | 11/1984 | Nikolich | 227/10 |
| 4,593,845 | 6/1986 | Andersson et al. | 227/112 |
| 5,197,646 | 3/1993 | Nikolich | 227/8 |

FOREIGN PATENT DOCUMENTS 72380 10/1993 Japan .

OTHER PUBLICATIONS

Three undated pages from instruction manual for Paslode Pneumatic Nailer.

*Primary Examiner*—Rinaldi I. Rada
*Assistant Examiner*—Allan M. Schrock
*Attorney, Agent, or Firm*—Dressler, Goldsmith, Shore & Milnamow, Ltd.

[57] ABSTRACT

A combustion-powered, fastener-driving tool comprises a structure defining a combustion chamber and defining a driving piston cylinder, which has a wall and defines an axis. A nosepiece is mounted to said structure and communicates with the driving piston cylinder. A driving piston mounting a driving member is arranged to be axially driven within the wall of the driving piston cylinder upon combustion of a fuel in the combustion chamber, so as to drive the driving member from an uppermost position wherein the driving member is retracted from the nosepiece into a lowermost position wherein the driving member is extended into the nosepiece. A combusted gases-actuated mechanism is employed for feeding fasteners from a collated strip of fasteners individually and successively into the nosepiece. Combusted gases are diverted from the driving piston cylinder so as to actuate the feeding mechanism when the driving piston is driven. Combusted gases are taken in through the wall of the driving piston cylinder, at a location between the uppermost position of the driving piston and the position of the driving piston when combusted gases are exhausted through one or more ports in the wall of the driving piston cylinder.

4 Claims, 4 Drawing Sheets

COMBUSTION-POWERED, FASTENER-DRIVING TOOL WITH GAS-ACTUATED, FASTENER-FEEDING MECHANISM

TECHNICAL FIELD OF THE INVENTION

This invention pertains to a combustion-powered, fastener-driving tool of a type employing a combustible fuel. The fastener-driving tool employs a high pressure, combusted gases-actuated, fastener-feeding mechanism, which employs combusted gases taken from a driving piston cylinder at a location between a retracted position of a driving piston and one or more exhaust ports.

BACKGROUND OF THE INVENTION

Combustion-powered, fastener-driving tools of the type noted above are exemplified in but not limited to Nikolich U.S. Pat. No. 5,197,646, Nikolich U.S. Pat. No. Re. 32,452, Nikolich U.S. Pat. Nos. 4,522,162, 4,483,474, and 4,403,722, and Wagdy U.S. Pat. No. 4,483,473. Such combustion-powered tools are available commercially from ITW Paslode (a unit of Illinois Tool Works Inc.) of Lincolnshire, Ill., under its IMPULSE trademark.

Generally, a combustion-powered, fastener-driving tool of the type noted above comprises a combustion chamber, into which a combustible fuel is injected, and in which the fuel is mixed with air and ignited. Moreover, a driving piston mounting a driving member is arranged to be axially driven within a driving piston cylinder, so as to drive the driving member from a retracted position into an extended position, upon combustion of the combustible fuel in the combustion chamber.

In pneumatically powered, fastener-driving tools, particularly such nail-driving tools, it is known to employ pressurized air-actuated, fastener-feeding mechanisms. Generally, such a pressurized air-actuated, fastener-feeding mechanism comprises a feeding mechanism cylinder and a feeding piston. Moreover, the feeding piston is movable within the feeding mechanism cylinder between a withdrawn position and an advanced position and is biased toward the advanced position, and a feeding claw mounted to the feeding piston is movable for engaging at least one fastener from a collated strip of fasteners when the feeding piston and the feeding claw are in the withdrawn position and for feeding a leading fastener from such a coil into the nosepiece when the feeding piston is moved from the withdrawn position into the advanced position. Combusted gases is diverted from the driving piston cylinder, ahead of the driving piston, into the feeding mechanism cylinder so as to move the feeding piston from the advanced position toward the retracted position when the driving piston is driven.

In pneumatically powered, fastener-driving tools provided with such gas-actuated, fastener-feeding mechanisms and available commercially from ITW Paslode, supra, under its PASLODE trademark, it is known for gases to be taken in substantially at an endmost location in the driving piston cylinder, beyond the position reached by the driving position when the driving member reaches the extended position.

In Japanese Laid-Open Utility Model Application No. 5-72380, which was laid open on Oct. 5, 1993, it is suggested to employ a gas-actuated, fastener-feeding mechanism in a combustion-powered, nail-driving tool of the type noted above. In a first embodiment illustrated in FIG. 1 of that Application, combusted gases taken in from a combustion chamber is diverted to actuate the fastener-feeding mechanism, so as to allow very little if any delay between driving of the driving piston and movement of the feeding piston from the advanced position into the withdrawn position. In a second embodiment illustrated in FIG. 10 of that Application, combusted air to be so diverted is taken in approximately where the driving piston ends its driving stroke, so as to apply a very short pulse of high pressure to the feeding piston.

However, it has been found that neither location illustrated in Japanese Laid-Open Utility Model Application No. 5-72380 is an optimum location for taking in combusted gases to actuate a gas-actuated, fastener-feeding mechanism in a rapidly acting, fastener-driving tool, particularly in a combustion-powered, fastener-driving tool of the type noted above. Moreover, the endmost location known in pneumatically powered, fastener-driving tools discussed above is not an optimum location therefor.

SUMMARY OF THE INVENTION

This invention provides a combustion-powered, fastener-driving tool of the type noted above. The fastener-driving tool comprises a structure defining a combustion chamber and defining a driving piston cylinder, which has a wall and defines an axis. Moreover, the fastener-driving tool comprises a nosepiece, which is mounted to said structure, and which communicates with the driving piston cylinder.

In the fastener-driving tool, a driving piston mounting a driving member is arranged to be axially driven within the wall of the driving piston cylinder upon combustion of a fuel in the combustion chamber, so as to drive the driving member from an uppermost position wherein the driving member is retracted from the nosepiece into a lowermost position wherein the driving member is extended into the nosepiece.

The fastener-driving tool further comprises gas-actuated means for feeding fasteners from a collated strip of fasteners individually and successively into the nosepiece, means for exhausting combusted gases from the driving piston cylinder after the driving piston has been driven from the uppermost position toward the lowermost position, and means for diverting combusted gases from the driving piston cylinder so as to actuate the feeding means when the driving piston is driven, the diverting means being arranged to take in combusted gases through the wall of the driving piston cylinder, at a location between the uppermost position of the driving piston and the position of the driving piston when combusted gases are exhausted by the exhausting means.

Preferably, the exhausting means comprises one or more ports in the wall of the driving piston cylinder, and the diverting means is arranged to take in combusted gases through the wall of the driving piston cylinder, at a location between the uppermost position of the driving piston and the port or ports.

These and other objects, features, and advantages of this invention are evident from the following description of a preferred embodiment of this invention with reference to the accompanying drawings.

DESCRIPTION OF PREFERRED EMBODIMENT

Figure 1:
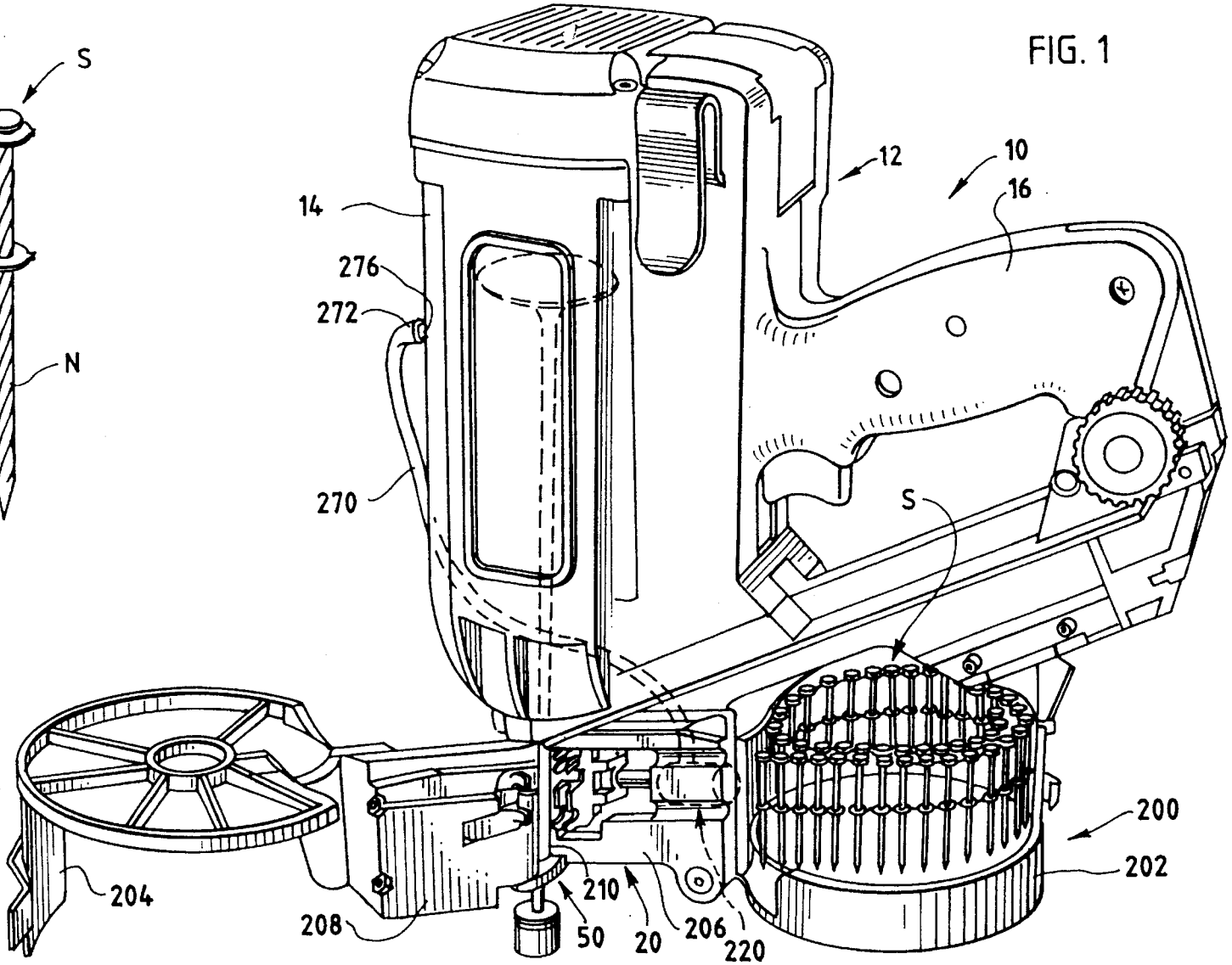
FIG. 1 is a perspective view of a combustion-powered, fastener-driving tool embodying this invention and employing a gas-actuated, fastener-feeding mechanism, which is shown in an opened condition to reveal details that would be otherwise hidden.

As shown in the drawings, a combustion-powered, fastener-driving tool 10 of the type noted above constitutes a preferred embodiment of this invention. The tool 10 is designed to drive fasteners, such as nails N, from a coiled strip S of such fasteners individually and successively. The strip S is shown fragmentarily in broken lines in FIG. 1 and in unbroken lines in FIG. 2.

Generally, except as illustrated and described herein, the tool 10 is similar to the combustion-powered, fastener-driving tool illustrated and described in the Nikolich patents noted above, the disclosures of which are incorporated herein by reference, particularly but not exclusively Nikolich U.S. Pat. No. 5,197,646. Herein, directional terms including "upper", "lower", and terms of similar import are used to refer to the tool 10 in a convenient orientation, in which the tool 10 is shown in the drawings. It should be understood that this invention is not limited to any particular orientation.

Figure 2:
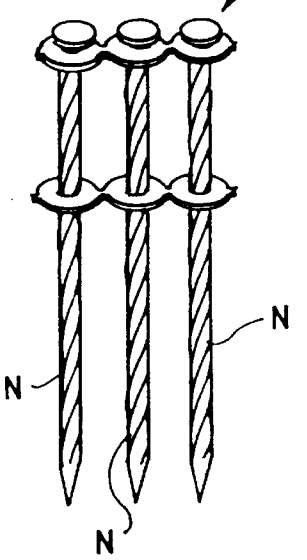
FIG. 2 is an enlarged, fragmentary detail of a portion of a coiled, collated strip of fasteners, as employed in the tool shown in FIG. 1.

The tool 10 includes a generally hollow housing structure 12 molded from a suitable engineering polymer. The housing structure 12 has a principal portion 14 and a handle portion 16. The housing structure 12 mounts a high pressure, combusted gases-actuated, fastener-feeding mechanism 20 for feeding nails N individually and successively into the tool 10. As shown in FIG. 2, each nail N has an elongate, pointed shank and an enlarged head, and the nails N are collated with frangible, polymeric members so as to form the strip S, which is coiled when loaded into the feeding mechanism 20.

Figure 7:
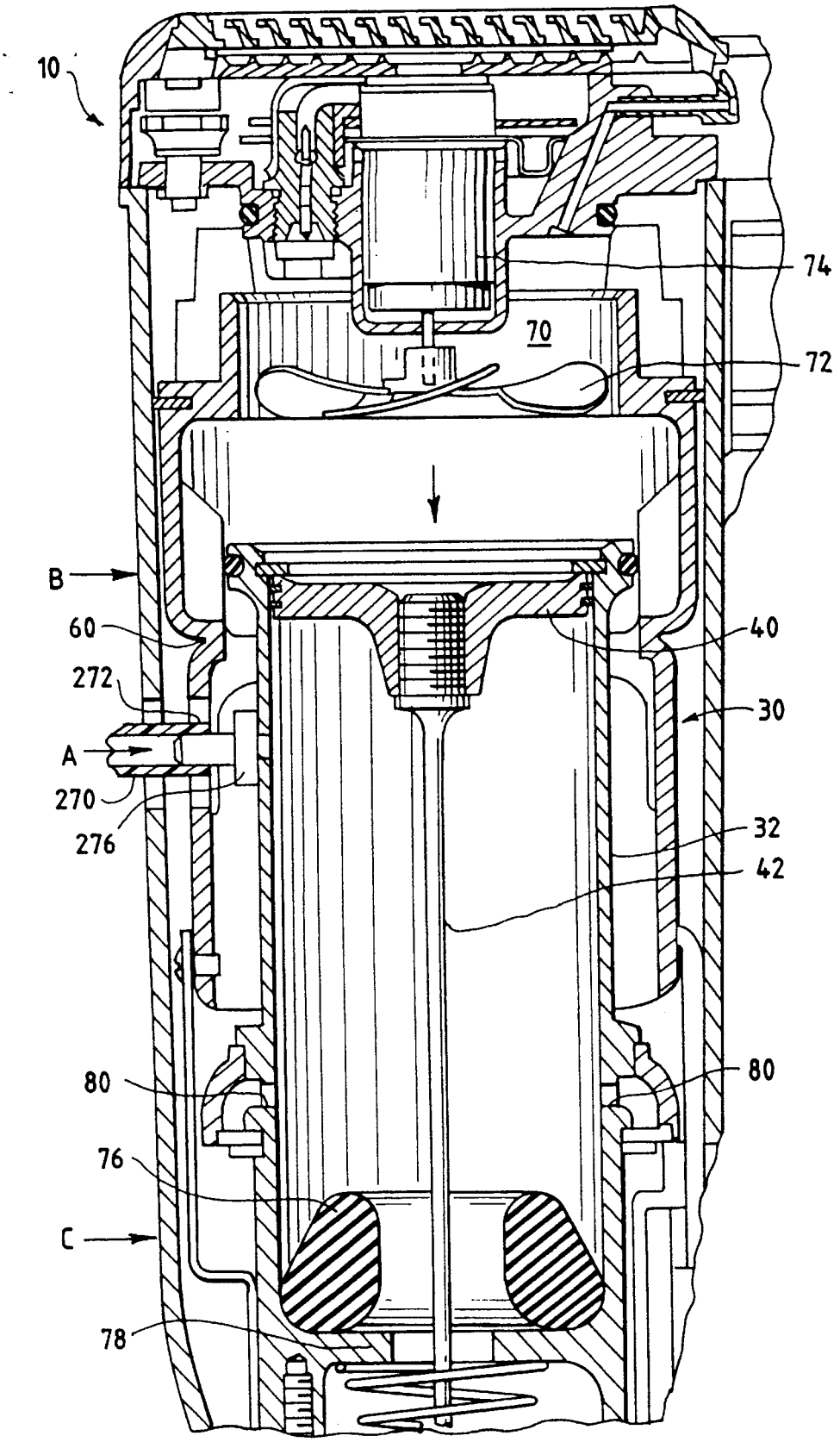
FIG. 7 is an enlarged, fragmentary, sectional view taken through portions of the fastener-driving tool, as shown in FIG. 1.

As shown in FIGS. 1 and 7, the tool 10 comprises a cylinder body 30 mounted fixedly within the housing structure 12. The cylinder body 30 defines a driving piston cylinder 32, which defines an axis, and a blade orifice (not shown) below the driving piston cylinder 32. The driving piston cylinder 32 has a cylindrical wall 34. A piston 40, which may be conveniently called a driving piston to distinguish it from another piston to be later described, is movable axially within the cylindrical wall 34 of the driving piston cylinder 32 between an uppermost position, in which the piston 40 is shown in FIG. 7, and a lowermost position. A driving blade 42 is attached to the piston 40 so as to extend axially from the piston 40 and so as to be axially and conjointly movable with the piston 40. The driving blade 42 is arranged to be forcibly and rapidly driven downwardly with the piston 40, from the upper position so as to drive a nail N from the tool 10, into a workpiece (not shown) in a known manner.

As shown in FIG. 1, the tool 10 comprises a nosepiece 50 mounted to the cylinder body 30 so as to extend below the housing structure 12. The feeding mechanism 20 is mounted to the nosepiece 50 as well as to the handle portion 16 of the housing structure 12. The nosepiece 50 functions for receiving a nail N from the feeding mechanism 20, before the nail N is engaged by the driving blade 42, and for guiding the nail N as the nail is driven by the driving blade 42.

A valve member 60 and the cylinder body 30 define a combustion chamber 70. The valve member 60 is described in Nikolich U.S. Pat. No. 5,197,646. A fan 72, which is driven by a battery-powered, electric motor 74, is mounted operatively in the combustion chamber 70. The fan 72 functions, in a known manner, to produce turbulence in the combustion chamber 70 before combustion of a combustible fuel occurs in the combustion chamber 70.

As shown in FIG. 7, an annular, elastomeric bumper 76 is disposed within the driving piston cylinder 32, on an annular ledge 78, below the piston 40. The bumper 76 functions, in a known manner, to arrest downward movement of the piston 40 and the driving blade 42 and to absorb resultant shocks.

The combustion chamber 70 opens into the driving piston cylinder 32, above the driving piston 40, when the driving piston 40 is driven downwardly from the uppermost position. The driving piston cylinder 32 has exhaust ports 80 (two shown) which function for exhausting combusted gases from the driving piston cylinder 32, above the driving piston 40, when the driving piston 40 has been driven downwardly past the exhaust ports 80.

Figure 3:
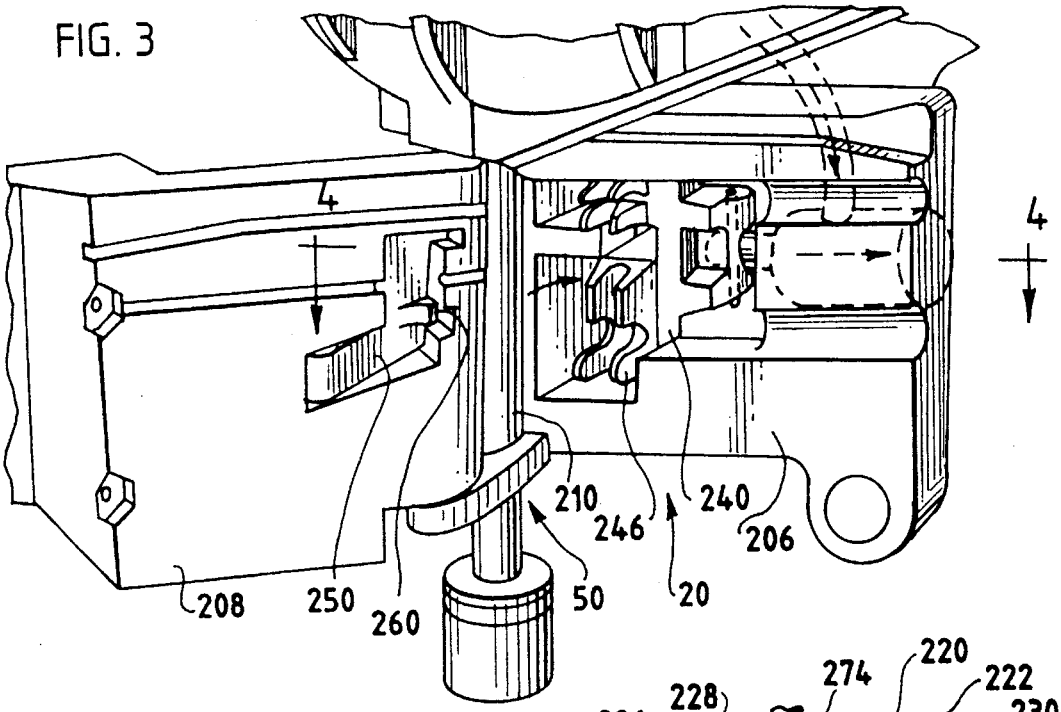
FIG. 3 is an enlarged, fragmentary detail of the fastener-feeding mechanism, as shown in FIG. 1.

The fastener-feeding mechanism 20 comprises a canister 200, which includes a fixed portion 202 and a pivotable portion 204. The fixed portion 202 is fixed to the housing structure 12 and the nosepiece 50 via an arm 206. The pivotable portion 204 is connected pivotably to the fixed portion 202 via an arm 208, which is hinged to the arm 206 via a hinge 210, and is pivotable between an opened position, in which it is shown in FIGS. 1 and 3, and a closed position. The pivotable portion 204 is pivoted to the opened position for loading of a coiled strip S into the canister 200 and to the closed position for operation of the mechanism 20. The mechanism 20 also comprises a friction latch 212 for latching the pivotable portion 204 releasably in the closed position. The arms 206, 208, define a fastener-feeding track.

The mechanism 20 comprises a feeding mechanism cylinder 220, which is mounted fixedly to the arm 206 and which has a cylindrical wall 222, a closed, inner end 224, and an annular bushing 226 fixed within the cylindrical wall 222 at the outer end 228 of the feeding mechanism cylinder 220. The mechanism 20 also comprises a feeding piston 230, which is movable within the cylindrical wall 222 between a withdrawn position and an advanced position and which mounts a piston rod 232. The piston rod 232 is guided by the annular bushing 226 so as to be conjointly movable with the feeding piston 230. The mechanism 20 further comprises a coiled spring 234, which is seated against the closed end 224 and which biases the feeding piston 230 toward the advanced position. An O-ring 236 is seated in a peripheral groove of the feeding piston 230 and bears against the cylindrical wall 222 as the feeding piston 230 is moved within the cylindrical wall 222.

Figure 4:
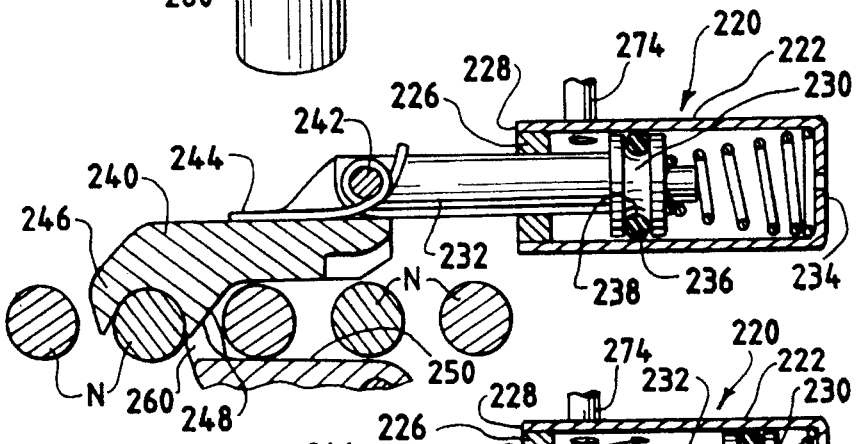
FIG. 4 is a sectional view taken along line 4—4 of FIG. 3, in a direction indicated by arrows.
Figure 5:
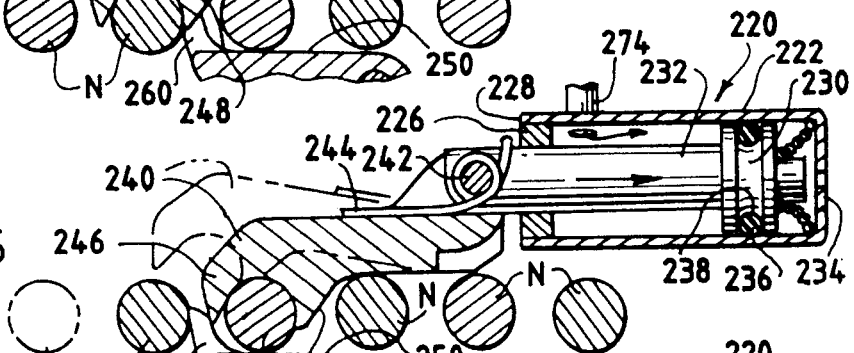
FIGS. 5 and 6 are similar, sectional views showing successive stages in operation of the fastener-feeding mechanism.
Figure 6:
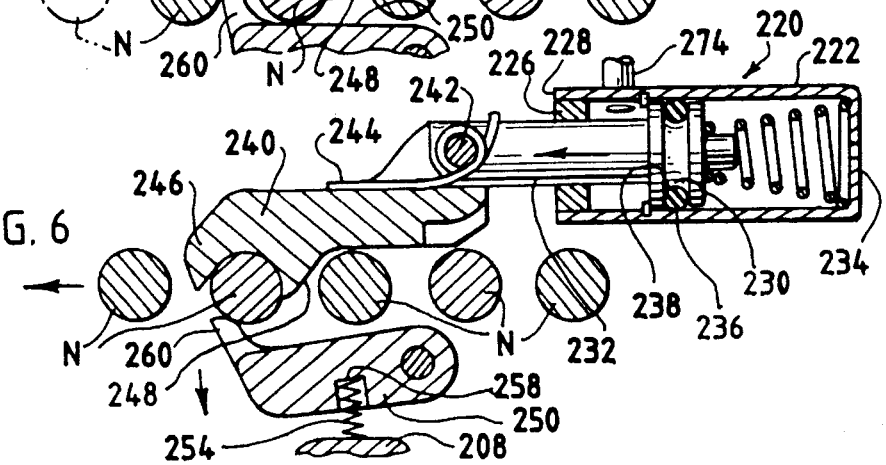

The mechanism 20 comprises a feeding claw 240, which is mounted pivotably to the piston rod 232 via a pivot pin 242, so as to be conjointly movable with the piston rod 232 and the feeding piston 230 between the withdrawn and advanced positions but so as to be pivotably movable on the pivot pin 242 between an operative position and an inoperative position. In FIGS. 4, 5, and 6, the feeding claw 240 is shown in the operative position in unbroken lines and in the inoperative position in broken lines. The mechanism 20 also comprises a torsion spring 244 mounted on the pivot pin 242 and biasing the feeding claw 240 toward the operative position.

The feeding claw 240 has notched end fingers 246, which are adapted to engage one of the nails N of the strip S when the feeding claw 240 is in the operative position and to advance the strip S when the feeding piston 230, the piston rod 232, and the feeding claw 240 are moved by gas pressure from the withdrawn position of the feeding piston 230 into the advanced position of the feeding piston 230. The notched end bumpers 246 have a camming surface 248, which is adapted to cam over the next nail N in the strip S so to cause the feeding claw 240 to pivot from the operative position into the inoperative position when the feeding piston 230, the piston rod 232, and the feeding claw 240 are moved by the coiled spring 234 from the advanced position of the feeding piston 230 into the withdrawn position of the feeding piston 230.

The mechanism 20 comprises a holding claw 250, which is mounted pivotably to the arm 208 via a pivot pin 252 so as to be pivotable between an engaging position and a disengaging position. The holding claw 250 is shown in the engaging position in FIGS. 4 and 5 and in the disengaging position in FIG. 6. A coiled spring 254, which has one end seated in a socket 258 in the holding claw 250 and its other end bearing against the arm 208, biases the holding claw 250 to the engaging position. The holding claw 250 has distal end fingers 260, which are adapted to fit between two nails N of the strip S, to engage the preceding nail N, and to hold the engaged nail N so that the strip S including the engaged nail N does not move with the feeding claw 240 when the feeding piston 230, the piston rod 232, and the feeding claw 240 are moved by the coiled spring 234 from the withdrawn position of the feeding piston 230 into the advanced position of the feeding piston 230.

Except as illustrated and described herein, the fastener-feeding mechanism 20 is similar to combusted air-powered, fastener-feeding mechanisms provided with pneumatically powered, fastener-driving tools available commercially from ITW Paslode, supra. The mechanism 20 comprises a conduit 270. As shown in FIGS. 1 and 7, an inlet end 272 of the conduit 270 is connected to the cylindrical wall 34 of the driving piston cylinder 32, via a suitable fitting 276. As shown in FIGS. 4, 5, and 6, an outlet end 274 of the conduit 270 is connected to the cylindrical wall 222 of the feeding mechanism cylinder 220. The conduit 270 functions for diverting combusted gases from the driving piston cylinder 32 into the feeding mechanism cylinder 220, against the feeding piston 230, so as to move the feeding piston 230, the piston rod 232, and the feeding claw 240 from the advanced position of the feeding piston 230 into the withdrawn position of the feeding piston 230.

In accordance with this invention, the conduit 270 is connected to the wall 34 of the driving piston cylinder 32, via the fitting 276 at the inlet end 272 of the conduit 270, so as to take in combusted gases from the driving piston cylinder 32 at a location between the uppermost position of the driving piston 40 and the position of the driving piston 40 when combusted gases are exhausted from the driving piston cylinder 32, via the exhaust ports 80.

Figure 8:
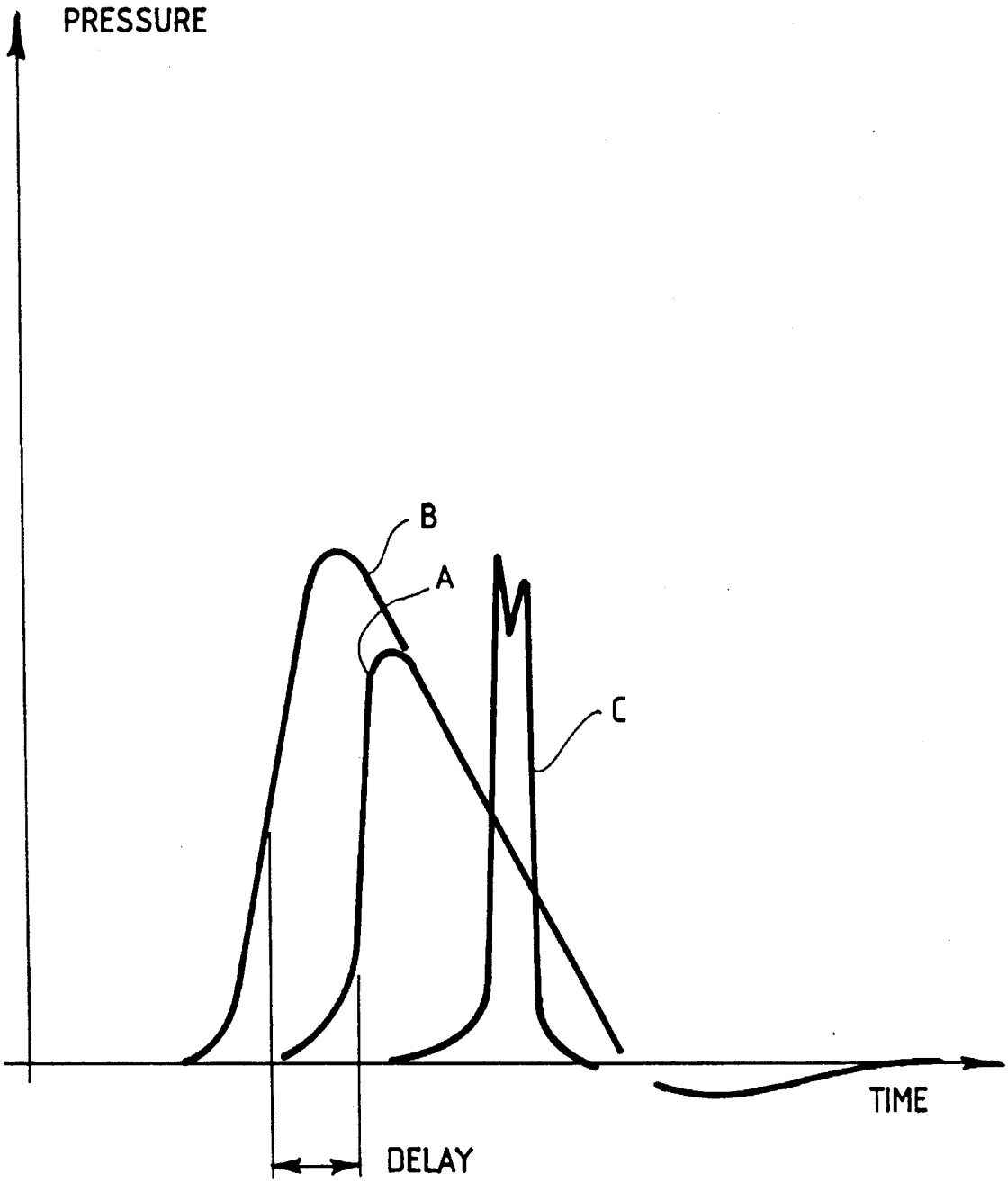
FIG. 8 is a graph of pressure versus time, for pressure applied to the fastener-feeding mechanism and taken at three locations marked "A", "B", and "C" respectively.

FIG. 8 is graph of pressure versus time for pressure applied to the mechanism 20 and taken in at three locations marked "A", "B", and "C" respectively. Location "A" is an optimum location, as employed in the illustrated embodiment, in which the initial portion of the stroke length is comprised of approximately one fourth of the stroke length. Thus, between initiation of movement of the driving piston 40 and initiation of movement of the feeding piston 230, there is a minute delay, during which the strip S remains held by the feeding claw 240 and the feeding claw 250. Also, after the minute delay, a positive, reliable pressure pulse is applied to the feeding piston 230.

Near the retracted position of the driving piston, as in the first embodiment disclosed in Japanese Laid-Open Utility Model Application No. 5-72380, location "B" would not be an optimum location, as there would be essentially no delay between initiation of movement of the driving piston 40 and initiation of movement of the feeding piston 230. Thus, gas energy is taken away from the driving piston during the very sensitive initial acceleration of its stroke. Also, the pressure pulse to the fastener-feeding mechanism comes too early, leaving the nail to be driven in a not well supported position.

Near the bumper 76, as in the second embodiment disclosed in Japanese Laid-Open Utility Model Application No. 5-72380, location "C" would not be an optimum location, as the pressure pulse would be of a much shorter duration and would be more sensitive to ambient conditions.

Various modifications may be made in the preferred embodiment described above without departing from the scope and spirit of this invention.

I claim:

1. A combustion-powered, fastener-driving tool of a type employing a combustible fuel, the fastener-driving tool comprising (a) a structure defining a combustion chamber and defining a driving piston cylinder, the driving piston cylinder having a wall and defining an axis, and a nosepiece mounted to said structure, the nosepiece communicating with the driving piston cylinder, (b) a driving piston mounting a driving member, the driving piston being arranged to be axially driven within the wall of the driving piston cylinder upon combustion of a fuel in the combustion chamber, so as to drive the driving member from an uppermost position wherein the driving member is retracted from the nosepiece into a lowermost position wherein the driving member is extended into the nosepiece, (c) means including a bumper for arresting the driving piston when the driving piston is driven into the lowermost position, (d) gas-actuated means for feeding fasteners from a collated strip of fasteners individually and successively into the nosepiece, (e) means for exhausting combusted gases from the driving piston cylinder after the driving piston has been driven from the uppermost position toward the lowermost position, and (f) means for diverting combusted gases from the driving piston cylinder so as to actuate the feeding means when the driving piston is driven, the diverting means being arranged to take in combusted gases through the wall of the driving piston cylinder, at a location between the uppermost position of the driving piston and the exhausting means.

2. The fastener-driving tool of claim 1 wherein the driving piston is driven along a stroke length between the uppermost and lowermost positions and wherein the diverting means is arranged to take in combusted gases when the driving piston has been driven from the uppermost position, toward the lowermost position, over an initial portion of the stroke length, the initial portion being comprised of approximately one fourth of the stroke length.

3. The fastener-driving tool of claim 1 wherein the exhausting means comprises one or more ports in the wall of the driving piston cylinder, the diverting means being arranged to take in combusted gases through the wall of the driving piston cylinder, at a location between the uppermost position of the driving piston and said one or more ports.

4. The fastener-driving tool of claim 3 wherein the driving piston is driven along a stroke length between the uppermost and lowermost positions and wherein the diverting means is arranged to take in combusted gases when the driving piston has been driven from the uppermost position, toward the lowermost position, over an initial portion of the stroke length, the initial portion being comprised of approximately one fourth of the stroke length.

* * * * *